United States Patent [19]

Hofmann et al.

[11] Patent Number: 4,548,356

[45] Date of Patent: Oct. 22, 1985

[54] FUEL INJECTION NOZZLE FOR INTERNAL COMBUSTION ENGINES

[75] Inventors: Karl Hofmann, Remseck; Erich Jäger, Korb, both of Fed. Rep. of Germany

[73] Assignee: Robert Bosch GmbH, Stuttgart, Fed. Rep. of Germany

[21] Appl. No.: 522,766

[22] Filed: Aug. 12, 1983

[30] Foreign Application Priority Data

Oct. 13, 1982 [DE] Fed. Rep. of Germany ..... 3237932

[51] Int. Cl.[4] ..... B05B 9/00

[52] U.S. Cl. ..... 239/126; 210/416.4; 239/533.3; 239/575

[58] Field of Search ..... 239/533.2–533.12, 239/575, 584, 585, 124, 126; 210/136, 416.4; 137/544, 545, 549

[56] References Cited

U.S. PATENT DOCUMENTS

| | | | |
|---|---|---|---|
| 1,300,653 | 4/1919 | Roper | 210/136 |
| 2,605,142 | 7/1952 | Gold et al. | 239/533.2 |
| 2,621,077 | 12/1952 | Pieroni | 239/533.2 |
| 3,143,163 | 8/1964 | Renner | 239/533.2 |
| 3,223,331 | 12/1965 | Baker | 239/533.2 |
| 3,314,481 | 4/1967 | Willman et al. | 210/136 |
| 3,912,630 | 10/1975 | Reighard et al. | 210/136 |
| 3,980,234 | 9/1976 | Bouwkamp | 239/584 |
| 4,306,681 | 12/1981 | Laitio et al. | 239/533.3 |

FOREIGN PATENT DOCUMENTS

| | | | |
|---|---|---|---|
| 2028453 | 12/1971 | Fed. Rep. of Germany | 239/533.3 |

*Primary Examiner*—Andres Kashnikow
*Assistant Examiner*—Michael J. Forman
*Attorney, Agent, or Firm*—Edwin E. Greigg

[57] ABSTRACT

A fuel injection nozzle for internal combustion engines having a filter body inserted into the fuel inflow conduit, an injection valve and a check valve, which maintains a static pressure in the injection nozzle and can also perform a relief function for the prevention of after-injections. The check valve is integrated into the filter body thereby simplifying the final assembly of the injection nozzle. The filter body is advantageously embodied as a rod-type filter, which by the appropriate shaping of its jacket periphery forms gap-like spaces between itself and the surrounding wall of the nozzle holder through which spaces the fuel must pass such that it is deflected multiple times.

12 Claims, 4 Drawing Figures

FUEL INJECTION NOZZLE FOR INTERNAL COMBUSTION ENGINES

BACKGROUND OF THE INVENTION

The invention is based on a fuel injection nozzle in which a fuel conduit leads via a filter body located in the nozzle housing to an injection valve at the injection ports, and a check valve which is installed in the fuel conduit and opens in the direction of fuel flow. This check valve may be provided in order to maintain a certain static pressure in the injection nozzle, so that when the injection valve closes combustion gases are prevented from reaching its valve seat and contaminating it. This could happen, for instance, in injection systems intended for small, high-speed motors in which the buildup of fuel pressure takes place very quickly following the end of injection. The check valve may additionally serve as a relief means and for receiving the positively-displaced fuel volume, thereby preventing the after-injections this fuel volume causes.

In a known injection nozzle of the type generally described above (German Pat. No. 715 51), the check valve is built into the fuel conduit directly, and the valve seat and the support surface for the closing spring are embodied on adjacent parts of the nozzle housing. This kind of embodiment makes the final assembly of the injection nozzle difficult, because additional care must then be taken that the valve elements are inserted correctly, and it may even be necessary to take measures to prevent the valve elements from falling out unintentionally from the hollow spaces provided in the nozzle housing for receiving them.

OBJECT AND SUMMARY OF THE INVENTION

The apparatus according to the invention and having the characteristics of the main claim has the advantage over the prior art that the check valve and the filter body represent a single functional group, which can be assembled beforehand as a unit and then inserted or pressed into the nozzle housing, for instance into the nozzle holder. As a result, the final assembly of the injection valve becomes substantially simplier, and the further advantage is attained that the exact bores and fittings of the check valve can be disposed on the relatively small filter body, independently of the nozzle housing.

As a result of the characteristics disclosed, advantageous further embodiments of the apparatus disclosed can be attained.

The closing member of the check valve can also, when disposed in the filter body, be embodied as a relief piston, in order to receive the displacement volume of the injection valve and prevent after-injections.

The embodiment of the filter body as a linear-type filter which is inserted into the fuel conduit and which together with the surrounding walls of the fuel conduit defines filter gaps is particularly well suited for the installation of a check valve.

Th structural characteristics result in a compact realization of the filter body, in which the check valve, which may also be assigned a relief function, does not impair the filtering effect.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
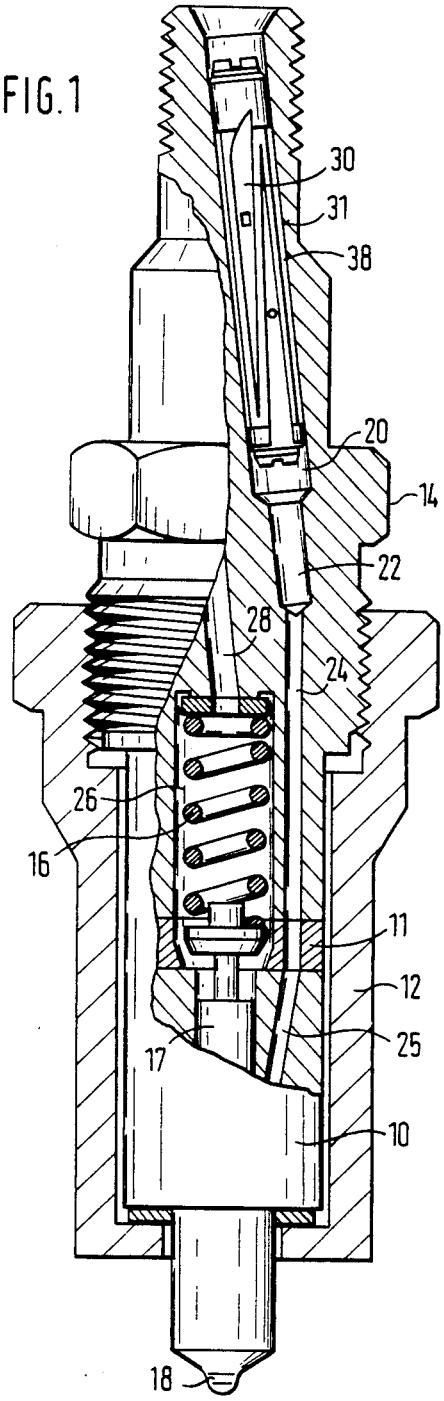
FIG. 1 shows an injection nozzle in longitudinal section, having a rod-type filter embodied in accordance with the invention.

The injection nozzle has a nozzle body 10 which together with a shim 11 is firmly fastened to a nozzle holder 14 via a tensioning nut 12. The nozzle body 10, in the conventional manner, contains a valve needle 17 which is displaceable counter to the force of a closing spring 16, the valve needle 17 monitors a valve seat which is disposed in the nozzle body 10 preceding injection ports 18. The nozzle holder 14 contains a fuel inflow conduit, which comprises three bore segments 20, 22, 24 of differing diameters. The bore segment 24 corresponds with a conduit 25 in the nozzle body 10, which discharges into a pressure chamber surrounding the valve needle 17. In the vicinity of the pressure chamber, the valve needle 17 is provided with a pressure shoulder, and the pressure chamber communicates via an annular chamber between the valve needle 17 and the bore of the nozzle body 10 with the valve seat. The valve needle 17 is displaced by the pressure of the inflowing fuel counter to the force of the closing spring 16, as a result of which the valve is opened and the fuel travels to the injection ports 18. The leakage oil entering the chamber 26 receiving the closing spring 16 is carried via a further bore 28 to a fitting, not visible in the drawing, intended for effecting the connection of a leakage oil line.

A linear-type filter body 30 is inserted into the bore segment 20 of the fuel inflow conduit, forcing the inflowing fuel to pass through narrow gaps formed between the shaped outer periphery of the filter body 30 and the surrounding wall 31 of the bore segment 20. The fuel is thereby filtered, and any dirt particles, chips and the like carried along with it which are beyond a predetermined size are restrained there.

Figure 2:
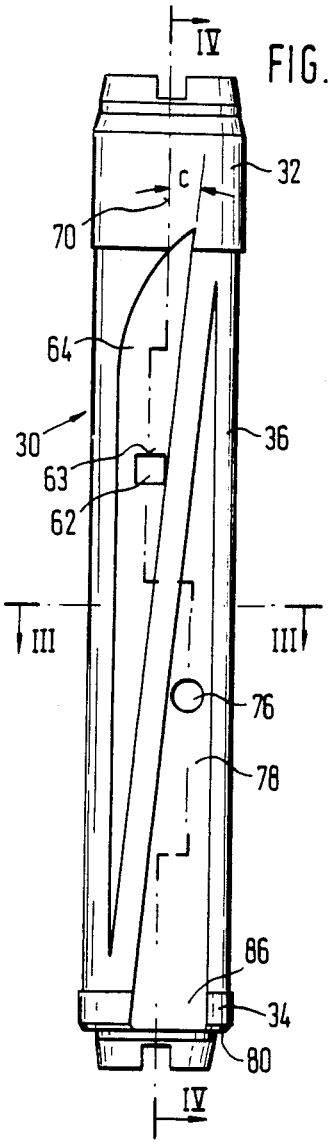
FIG. 2 shows the rod-type filter of FIG. 1 on an enlarged scale and in an upright position.

Going into detail, the filter body 30 is provided at each of its two ends which a collar 32, 34 (FIG. 2), between which a middle segment 36 of slightly reduced diameter is located. The two collars 32, 34 fill up the bore segment 20 in the nozzle holder 14 completely in a fitting manner and thus hold the filter body 30 firmly therein by frictional force. As a result of this embodiment of the filtered body 30, an annular chamber 38 is formed between its middle segment 36 and the bore wall 31 of the nozzle holder 14, by way of which annular chamber 38 the fuel must pass in the manner to be described in further detail below.

The filter body 30 is provided with a longitudinal bore 40 extending all the way therethrough, into which a hollow screw 42 is inserted on the inflow side and which is closed off at the output side by a threaded plug 44. The hollow screw 42 is provided with an axial extension 46 and a central bore 48, which discharges at the end 50 of the extension 46. The threaded plug 44 has an extension 52, which has an end tang 54 and supports a closing spring 56, which passes a piston-like closing member 60 against the end 50 of the hollow screw 42.

Figure 3:
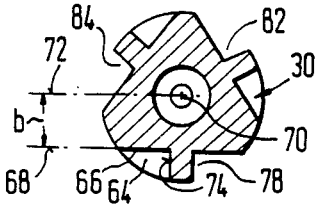
FIG. 3 is a section taken along the line III—III of FIG. 2.

A first transverse bore 62 leads out from the longitudinal bore 40; this transverse bore 62 has a rectangular cross section, and its wall segment 63 on the inflow side is offset by the dimension a from the end 50 of the hollow screw 42. The transverse bore 62 leads into a longitudinal groove 64 on the jacket periphery of the filter body 30, which when viewed in the direction of fuel flow has a V-shaped cross section of continuously descreasing size and terminates at both ends prior to the end faces of the filter body 30. The first flank 66 (FIG. 3) of the longitudinal groove 64 is located in a plane 68, which extends at a distance b from a plane 72 including the longitudinal axis 70 of the filter body 30. The other flank 74 of the longitudinal groove 64 is located upright on the flank 66 and extends at an angle c (FIG. 2) relative to the longitudinal axis 70 of the filter body 30. As a result of this cross-sectional embodiment and disposition, the decreasing depth of the longitudinal groove 64 is attained automatically during the milling process.

A second transverse bore 76 having a circular cross section leads out from the longitudinal bore 40 in the vicinity of the end tang 54, and discharges into a longitudinal groove 78 on the jacket periphery of the filter body 30. The longitudinal groove 78 is embodied in cross section as a mirror image of the longitudinal groove 64 and, like it, is disposed at an angle c with respect to the longitudinal axis 70. The longitudinal groove 78 is located, however, such that it pierces the collar 34 on the outflow side and discharges at the annular end face 80 defining this collar 34. Two further longitudinal grooves 82, 84 are disposed in the filter body 30, being embodied and disposed like the longitudinal groove 78 and forming respective angles of 120° both between each other and with the longitudinal groove 78. Each longitudinal groove 78, 82 and 84 forms a peripheral recess 86 in the collar 34, by way of which recess the annular chamber 38 communicates with the ongoing bore segments 22, 24, 25 of the fuel inflow conduit.

Figure 4:
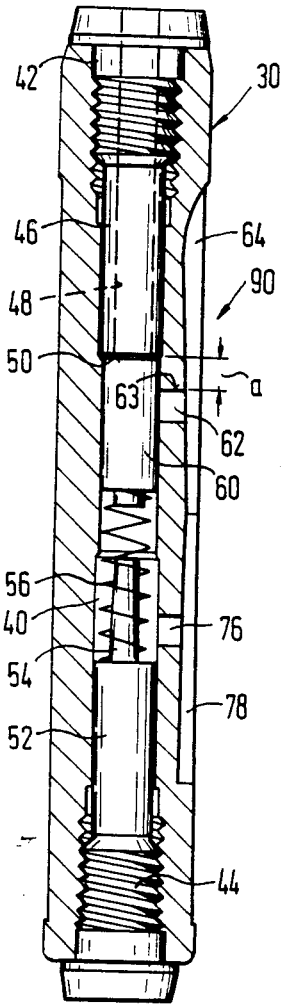
FIG. 4 is a section taken along the line IV—IV of FIG. 2.

The closing member 60, together with the end face 50 and the edge formed at the point where the transverse bore 62 discharges into the longitudinal bore 40, forms a check valve, shown in FIG. 4 and identified there as a unit by reference numeral 90. This check valve 90 is located in the line conection 48, 40, 62, 64 leading into the annular chamber 38 on the inflow side. From there, the fuel travels via the longitudinal grooves 78, 82, 84 and the three peripheral recesses 86 in the collar 34 into the continuing fuel conduit. The fuel is deflected multiple times thereby and forced to flow through narrow gaps, as a result of which the desired filtering effect takes place.

The fuel pressure, which at the beginning of an injection event is increasing, displaces the closing member 60 away from the end face 50 counter to the force of the closing spring 56, until the closing member 60 opens the transverse bore 62 and the fuel can pass over to the gaps and conduits continuing on from there. The fuel volume positively displaced by the closing member during this process can pass over via the transverse bore 76 and the longitudinal groove 78 into the fuel conduit continuing from there. At the end of the injection event, the closing spring 56 rapidly returns the closing member 60 back to the end face 50, thereby closing the transverse bore 62 and causing the reaspiration via the transverse bore 76 of a certain volume of fuel into the space between the closing member 60 and the threaded plug 44. The distance a is dimensioned such that the reaspirated fuel volume approximately corresponds to the positively displaced volume of the injection valve 17.

Thus, as the closing member 60 moves across transverse bore 62 to close bore 48 further inflow of fuel toward the injection valve is prevented at such time that the transverse bore 62 is closed. As the closing member 60 moves the distance "a" from the transverse bore 62, fuel under pressure between the injection valve 17 and the second transverse bore 76 enters the longitudinal bore 40 via the second transverse bore 76 to fill the space in bore 40 due to movement of closing member 60, as the closing member moves the distance a. Since no fuel is added from the inlet to the injection valve via transverse bore 62, the fuel entering bore 40 relieves the fuel pressure on the injection valve 17 so that the injection valve closes. The volume of fuel that replaces the area in bore 40 due to movement of closing member 60 and the area of the channel upstream of injection valve 17 due to a closing movement of the injection valve relieves the pressure on the injection valve so that the injection valve will remain closed. Therefore, the closing movement of closing member 60 functions as a relief valve to relieve the fuel pressure on the injection valve thereby preventing after-injections.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A fuel injection nozzle for internal combustion engines, said fuel injection nozzle including a nozzle holder, a nozzle body including an injection valve, a fuel flow conduit in said nozzle holder to said nozzle body and injection ports within said nozzle body, a fuel inlet conduit in said nozzle holder, a filter body inserted into said fuel inlet conduit in said nozzle holder, said filter body includes a longitudinal bore which extends axially through the filter body from an upper fuel inflow end and in which said longitudinal bore is closed off at its lower end by an end closure means;

a hollow screw means inserted into said upper fuel inflow end of said longitudinal bore, said hollow screw means having a bore extending all the way therethrough from end to end, a check valve in said longitudinal bore in said filter body between said hollow screw means and said end closure means, said check valve includes a closure member embodied as a relief piston which moves in a direction of fuel flow to permit fuel flow from said fuel inlet conduit into said longitudinal bore via said check valve and through a transverse bore in said filter body into an annular chamber along-side said filter body and through said fuel flow conduit in said nozzle holder to said injection valve, said hollow screw means includes an end face which forms a stop for said closure member of said check valve;

a closing spring disposed in a segment of said longitudinal bore that extends downstream from said closure member to said end closure means in which said closing spring is supported between said closure member at one end and on its other end by said lower end closure means of said filter body, and a tranversely disposed relief bore formed in said filter body which permits fluid flow between said segment of said longitudinal bore in which said closing spring is disposed and said annular chamber alongside said filter body.

2. An injection nozzle as defined by claim 1, wherein the filter body is embodied as a linear filter inserted into said fuel inlet conduit in said fuel injection nozzle holder and together with surrounding walls of said fuel inlet conduit of the nozzle holder define filtering gaps.

3. An injection nozzle as defined by claim 2, wherein said filter body is provided at its ends with upper and lower collars fittingly filling up the cross section of the fuel inlet conduit, said filter body is provided with a middle linear segment of slighly reduced diameter between said upper and lower collars which forms said annular chamber between the middle segment of said filter body and the surrounding wall of the fuel inlet conduit, said annular chamber communicates with a plurality of conduits in said filter body discharging at one end of the filter body via a plurality of peripheral recesses in said lower collar, and said check valve functions relative to said conduits in said filter body.

4. An injection nozzle as defined by claim 3, wherein said closing member of the check valve monitors said transverse bore which discharges into the annular chamber.

5. An injection nozzle as defined by claim 3, wherein said filter body includes longitudinal grooves formed on its outer surface in which these grooves have a cross section which becomes smaller toward the upper end of said filter body.

6. An injection nozzle as defined by claim 1, wherein the end face of the hollow screw serving as a stop for the closing member is disposed at a distance (a) relative to the transverse bore such that the volume positively displaced up to the time the transverse bore is opened by the closing member corresponds to the positively displaced volume of the injection valve.

7. An injection nozzle as defind by claim 6, wherein the transverse bore discharges in the vicinity of a longitudinal groove in the periphery of the filter body, which groove terminates juxtaposed the upper and lower ends of the filter body.

8. An injection nozzle as defined by claim 7, wherein said filter body includes longitudinal grooves formed on its outer surface in which these grooves have a cross section which becomes smaller toward the upper end of said filter body.

9. An injection nozzle as defined by claim 6, wherein said filter body includes longitudinal grooves formed on its outer surface in which these grooves have a cross section which becomes smaller toward the upper end of said filter body.

10. An injection nozzle as defined by claim 1, wherein the transverse bore discharges in the vicinity of a longitudinal groove in the periphery of the filter body, which groove terminates juxtaposed the upper and lower ends of the filter body.

11. An injection nozzle as defined by claim 1, wherein said filter body includes longitudinal grooves formed on its outer surface in which these grooves have a cross section which becomes smaller toward the upper end of said filter body.

12. An injection nozzle as defined in claim 1 wherein; said end closure means is a screw plug.

* * * * *